US005810361A

United States Patent [19]

Kadlic

[11] Patent Number: 5,810,361

[45] Date of Patent: Sep. 22, 1998

[54] AMERICAN CANASTA

[76] Inventor: Thomas P. Kadlic, 4505 W. Hacienda Ave., Suite #G, Las Vegas, Nev. 89118

[21] Appl. No.: 863,485

[22] Filed: May 27, 1997

Related U.S. Application Data

[63] Continuation-in-part of Ser. No. 794,291, Feb. 3, 1997, which is a continuation-in-part of Ser. No. 336,271, Nov. 8, 1994, Pat. No. 5,601,488.

[60] Provisional application No. 60/024,449 Aug. 27, 1996.

[51] Int. Cl. [6] ..... A63F 1/00

[52] U.S. Cl. ..... 273/292; 463/26

[58] Field of Search ..... 273/292, 303, 273/306; 463/1, 25, 26, 27, 9–13

[56] References Cited

U.S. PATENT DOCUMENTS

| | | | |
|---|---|---|---|
| 5,022,653 | 6/1991 | Suttle et al. | 273/292 X |
| 5,374,067 | 12/1994 | Jones | 273/292 |
| 5,380,012 | 1/1995 | Jones et al. | 273/292 |
| 5,395,120 | 3/1995 | Malek | 273/292 |
| 5,431,408 | 7/1995 | Adams | 273/292 X |
| 5,437,451 | 8/1995 | Fulton | 273/292 X |
| 5,601,488 | 2/1997 | Kadlic | 273/292 X |

*Primary Examiner*—William E. Stoll

[57] ABSTRACT

A game of chance is based on the principles of traditional Canasta. Two Jokers are added to two standard fifty-two card decks to form a pack having 106 cards. The Jokers operate as wild cards and the Deuces are also considered as wild cards, resulting in a total of ten wild cards used in the method of play. Seven cards are initially dealt to the player from the original 106 card deck. The player selects which of the initial seven cards to hold and which to discard. Replacement cards from the original 106 card deck are displayed for the cards which have been discarded and the combinations created by the resulting seven card hand are compared against a payout table to determine which winning payoffs, if any, are received by the player. Preferred winning combinations are Seven of a Kind with no wild cards, Six of a Kind with no wild cards, Two Sets—one Four of a Kind and one Three of a Kind with no wild cards, Seven of a Kind with wild cards, Five of a Kind with no wild cards, Two Sets—one Four of a Kind and one Three of a Kind with wild cards, Two Sets—each being a Three of a Kind with no wild cards, Six of a Kind with wild cards, Four of a Kind with no wild cards, Five of a Kind with wild cards and Four of a Kind with wild cards.

6 Claims, 1 Drawing Sheet

| COINS PLAYED | 1st COIN | 2nd COIN | 3rd COIN | 4th COIN | 5th COIN |
|---|---|---|---|---|---|
| 7 OF A KIND (no wilds) | 10,000 | 20,000 | 30,000 | 40,000 | 50,000 |
| 6 OF A KIND (no wilds) | 500 | 1,000 | 1,500 | 2,000 | 2,500 |
| 2 SETS (one 4–one 3) (no wilds) | 125 | 250 | 375 | 500 | 625 |
| 7 OF A KIND (with wilds) | 100 | 200 | 300 | 400 | 500 |
| 5 OF A KIND (no wilds) | 40 | 80 | 120 | 160 | 200 |
| 2 SETS (one 4–one 3) (with wilds) | 25 | 50 | 75 | 100 | 125 |
| 2 SETS (both 3) (no wilds) | 15 | 30 | 45 | 60 | 75 |
| 6 OF A KIND (with wilds) | 8 | 16 | 24 | 32 | 40 |
| 4 OF A KIND (no wilds) | 4 | 8 | 12 | 16 | 20 |
| 5 OF A KIND (with wilds) | 2 | 4 | 6 | 8 | 10 |
| 4 OF A KIND (with wilds) | 1 | 2 | 3 | 4 | 5 |

| COINS PLAYED | 1st COIN | 2nd COIN | 3rd COIN | 4th COIN | 5th COIN |
|---|---|---|---|---|---|
| 7 OF A KIND (no wilds) | 10,000 | 20,000 | 30,000 | 40,000 | 50,000 |
| 6 OF A KIND (no wilds) | 500 | 1,000 | 1,500 | 2,000 | 2,500 |
| 2 SETS (one 4–one 3) (no wilds) | 125 | 250 | 375 | 500 | 625 |
| 7 OF A KIND (with wilds) | 100 | 200 | 300 | 400 | 500 |
| 5 OF A KIND (no wilds) | 40 | 80 | 120 | 160 | 200 |
| 2 SETS (one 4–one 3) (with wilds) | 25 | 50 | 75 | 100 | 125 |
| 2 SETS (both 3) (no wilds) | 15 | 30 | 45 | 60 | 75 |
| 6 OF A KIND (with wilds) | 8 | 16 | 24 | 32 | 40 |
| 4 OF A KIND (no wilds) | 4 | 8 | 12 | 16 | 20 |
| 5 OF A KIND (with wilds) | 2 | 4 | 6 | 8 | 10 |
| 4 OF A KIND (with wilds) | 1 | 2 | 3 | 4 | 5 |

AMERICAN CANASTA

CROSS-REFERENCE TO RELATED APPLICATION

This application is a Continuation-in-Part of application Ser. No. 08/794,291, filed Feb. 3, 1997, entitled "Electronic Rummy Game Apparatus", now pending, which is a Continuation-in-Part of application Ser. No. 08/336,271, filed Nov. 8, 1994, entitled "Electronic Rummy Game", now Pat. No. 5,601,488 and this application is also a Continuation-in-Part of Provisional Application Ser. No. 60/024,449, filed Aug. 27, 1996, entitled "American Canasta", now pending.

BACKGROUND OF THE INVENTION

This invention relates to an electronic video casino game, and more particularly to an electronic video casino game modeled after the traditional game of Canasta. The invention also relates to the method of play of an electronic video game that can be played as a non-gaming amusement game on a hand held apparatus or programmed on a stand alone amusement apparatus or onto a video cartridge that can be used with a television video entertainment system. The invention also relates to the method of play of a casino game which can be played as a live casino table game or as a live non-gaming amusement game.

There have been many types of electronic video gaming machines that have been developed. The electronic video poker gaming machine is designed to replicate the play of a hand of poker. Typically, the player is not playing against any other players' hands or against a dealer's hand; the player is simply attempting to achieve the highest ranking poker hand possible from the cards displayed to the player. The higher the poker hand ranking achieved by the player, the greater the player's winnings based on the number of coins, tokens or credits wagered by the player. Typically, a payout schedule is posted on the gaming machine to advise the player of the payoffs available for certain winning card combinations.

The forerunner of all electronic video poker gaming machines is the video Draw Poker machine that deals cards from a standard 52 card poker deck and displays a single five card hand to the player. The player then selects which of the five cards he wishes to hold (or discard depending on the format of the gaming machine). Upon activation by the player of the "Draw" button, the draw poker machine then displays replacement cards for the cards the player has discarded. The player wins or loses based on conventional poker hand rankings for the resulting five card hand. A payout table is established based on the number of coins, tokens or credits wagered by the player and the type of poker hand achieved.

The classic draw poker machine has been modified to use Jokers as wild cards or to use Deuces (or even other cards) as wild cards. "Joker's Wild" and "Deuces Wild" draw poker still display to the player a single five card hand and allow the player to discard unwanted cards and receive replacement cards. The payout table is modified to recognize the differing odds for achieving various poker hands when wild cards are involved.

Other types of poker games have been adapted to run on electronic video gaming machines. In the electronic version of seven card stud poker, the player wagers one or more coins, tokens or credits to be eligible to play the game and the player is dealt three cards initially. The player then has the option of folding in which case he loses his initial wager or betting additional coins, tokens or credits to receive additional cards. Eventually the player has either folded or received a full seven card hand. The player wins or loses based on conventional poker hand rankings for the best five cards of his seven card hand. A payout table is established based on the number of coins, tokens or credits wagered by the player and the type of poker hand achieved.

In the electronic version of five card stud poker, the player wagers one or more coins, tokens or credits to be eligible to play the game and the player is dealt four cards initially. The player then has the option of staying or betting additional coins, tokens or credits to increase the amount of a winning payout when he receives the fifth card. After the fifth card is dealt to the player, the value of his five card hand is determined based on conventional poker hand rankings for his five card hand. A payout table is established based on the number of coins, tokens or credits wagered by the player and the type of poker hand achieved.

U.S. Pat. No. 5,601,488 describes an electronic video casino game based on the principles of Gin Rummy. The disclosure of that patent (which is incorporated herein by this reference) includes an electronic gaming machine programmed to display an initial seven card hand to the player. The player selects which of the initial seven cards to hold and which to discard. Replacement cards are displayed for the cards which have been discarded and the combinations created by the resulting seven card hand are compared against a payout table to determine which winning payoffs, if any, are received by the player. Preferred winning combinations are seven, six, five, four and three card runs; four and three card groups and the combination (sets) of three or four card runs and three or four card groups.

Many of these electronic gaming machines have been adapted into amusement devices by eliminating the wagering aspects of the games. There exist hand-held, battery powered apparatus that replicate video draw poker and many of its variations that are played as amusement devices. The user simply plays the particular video poker game on the hand held amusement device and accumulates points instead of credits that can be redeemed as money.

The traditional game of canasta is a two team or two player game in which the teams or players compete against each other. Two standard fifty-two card decks of cards with four Jokers are used. Each player in the team game is initially dealt 11 cards while in the two player game each player is initially dealt 15 cards. In both versions, the play alternates with each player discarding and drawing from the card pile in attempt to achieve a winning meld combination. The players attempt to arrange their cards into groups (runs have no value). Whenever a player has a group of three or more cards, he lays those cards down on the table (melds) and the game continues until a player has laid all of his cards on the table and has gone "rummy". The teams/players score points for successfully laying their cards on the table and the team/player first to score 5000 points wins the game.

It is an object of the present invention to provide a new and exciting electronic video poker game that is easy to play and easy to learn based on the principles of canasta which is a card game that is played throughout the world.

It is a feature of the present invention to provide an electronic video or live table came card game based on the principles of canasta, but modified to be a single player game in which two decks of standard playing cards plus two Jokers are used thereby creating a 106 card pack. A player attempts to arrange the cards displayed on the video screen into a winning hand combination. The Jokers and Deuces function as wild cards in the play of the game.

It is also a feature of the present invention to display the method of playing a game of chance on a non-gaming amusement device such as a hand held amusement apparatus, a stand alone arcade game or even programmed on a video cartridge that can be used with an entertainment system that can be connected to a television set.

It is an advantage of the present invention that new and unique winning card combinations are achieved allowing very large winning payouts to be awarded to the player without having to extract a large initial wager from the player.

Other objects, features and advantages of the present invention will become apparent from a consideration of the following detailed description.

SUMMARY OF THE INVENTION

The method of the present invention involves a game of chance based on the principles of traditional canasta. An electronic gaming machine is programmed to display an initial seven card hand to the player. Two standard fifty-two card decks of playing cards with two Jokers added thereto are shuffled together to form a pack of playing cards having 106 cards. The Jokers operate as wild cards and the Deuces are also considered as wild cards, resulting in a total of ten wild cards used in the method of play.

On the initial deal of the cards, seven cards are displayed to the player from the original 106 card pack. The player selects which of the initial seven cards to hold and which to discard. Replacement cards from the original 106 card pack are displayed for the cards which have been discarded and the combinations created by the resulting seven card hand are compared against a payout table to determine which winning payoffs, if any, are received by the player.

Preferred winning combinations are Seven of a Kind (no wild cards), Six of a Kind (no wild cards), Two Sets—one Four of a Kind and one Three of a Kind (no wild cards), Seven of a Kind (with wild cards), Five of a Kind (no wild cards), Two Sets—one Four of a Kind and one Three of a Kind (with wild cards), Two Sets—each being a Three of a Kind (no wild cards), Six of a Kind (with wild cards), Four of a Kind (no wild cards), Five of a Kind (with wild cards) and Four of a Kind (with wild cards). The amount that the player wins is determined by the number of coins, tokens or credits wagered by the player and the type of winning hand combination achieved by the player.

In the preferred embodiment of the present invention, the method of play is displayed on a conventional electronic video poker machine which is modified by adding additional "Draw/Hold" buttons so that a total of seven "Draw/Hold" buttons are provided and by using computer software that displays the method of play and determines winning hand combinations and the payouts associated therewith.

The method of the present invention can also be practiced on a non-gaming amusement device in which the player accrues points for winning plays. The non-gaming amusement device can take the form of a hand-held amusement device operated by batteries or other suitable power sources, a stand-alone amusement apparatus or a video cartridge suitable for use with an entertainment system. Furthermore, the method of the present invention can also be played as a live casino table game or as a live non-gaming amusement game.

DETAILED DESCRIPTION OF THE PREFERRED EMBODIMENTS

Figure 1:
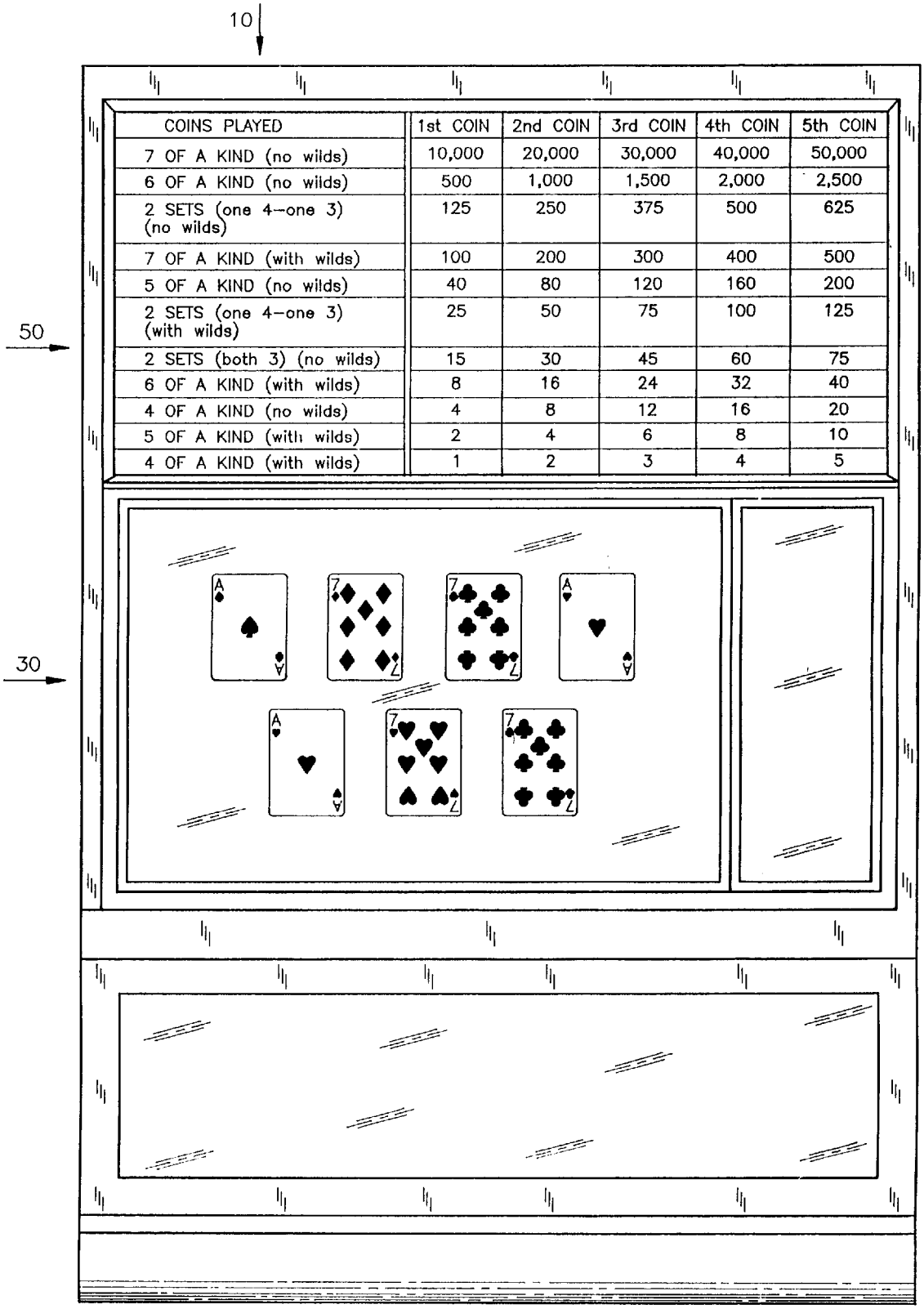
FIG. 1 shows a typical screen display and payout table used in the method of the present invention.

Two standard fifty-two card decks of playing cards are shuffled together and two Jokers are added to the combined deck to form a pack of playing cards having 106 cards. The Jokers operate as wild cards and the Deuces are also considered as wild cards, resulting in a total of ten wild cards used in the method of play. An electronic gaming machine is programmed to shuffle the pack of cards at the beginning of each hand and to display an initial seven card hand to the player.

A player inserts a coin or gaming token into a conventional coin head to activate the gaming machine. Alternatively, a player can insert currency into a conventional currency acceptor mechanism which will then increment a credit display the requisite number of credits corresponding to the value of the currency inserted by the player. In addition to using coin/token acceptor mechanisms or currency acceptor mechanisms or both, the method of the present invention is intended to also include credit coupons, credit or debit card systems, magnetically or optically read memory storage cards or any other apparatus or system by which monetary value can be input by the player and eventually displayed on the credit display on the gaming machine.

Once the player has accrued credits on the credit display by either inserting coins, gaming tokens or currency (or using any of the other methods, apparatuses or systems mentioned above), the gaming machine is active to be played. In one embodiment of the present invention, the player makes a wager by pressing either a Bet Max button (to wager the maximum number of credits for any one hand—typically five) or a Bet One button to wager one credit at a time. When the player presses one of the bet buttons, the credit display is decremented the number of credits wagered by the player.

Instead of using player-actuated buttons on a conventional button panel on the gaming machine, the video screen itself can be a touch-activated screen of the type currently being used extensively in electronic video gaming apparatus. The desired actions the player wishes to effect are accomplished by the player simply touching the video screen in the designated location on the screen.

After the player has selected the number of credits he wishes to wager on a particular hand, the player presses a Deal/Draw button (or presses the designated Deal/Draw location on the video screen) which causes the initial deal of the playing cards for that hand to be displayed on the video screen.

On the initial deal of the cards, seven cards from the pack of 106 cards are displayed to the player. As shown in FIG. 1, these seven cards can be displayed in two rows with four cards in the top row and three cards in the bottom row, however any suitable arrangement of the seven cards on the screen display may be used. The player selects which of the initial seven cards to hold and which to discard. Replacement cards from the original pack of 106 cards are displayed for the cards which have been discarded. A final seven card hand is displayed to the player.

As shown in FIG. 1, a sample seven card hand comprising four Sevens and three Aces has been achieved by the player after discarding from the initial seven card hand and drawing new cards.

The combinations created by the resulting seven card hand are compared against a payout table to determine which winning payoffs, if any, are received by the player. In the preferred embodiment of the present invention, a player must achieve at least Four of a Kind (with wild cards) to receive the lowest winning payout. Winning poker hands that do not utilize wild cards are paid higher amounts than the same type of poker hand that uses wild cards.

As shown in the payout table of FIG. 1, the preferred winning combinations in their order of ranking from highest to lowest are: Seven of a Kind (no wild cards), Six of a Kind (no wild cards), Two Sets—one Four of a Kind and one Three of a Kind (no wild cards), Seven of a Kind (with wild cards), Five of a Kind (no wild cards), Two Sets—one Four of a Kind and one Three of a Kind (with wild cards), Two Sets—each being a Three of a Kind (no wild cards), Six of a Kind (with wild cards), Four of a Kind (no wild cards), Five of a Kind (with wild cards) and Four of a Kind (with wild cards). The amount that the player wins is determined by the number of coins, tokens or credits wagered by the player and the type of winning hand combination achieved by the player.

The method of the present invention is played on a conventional electronic video poker machine which is modified by adding additional "Draw/Hold" buttons so that there is a "Draw/Hold" button associated with each of the initial seven cards that are dealt and displayed to the player. Alternatively, the selection of which cards to hold or discard can be effected using conventional touch screen technology. Computer software is used to program the gaming machine so that the gaming machine functions to display the method of play of the present invention and to determine winning hand combinations and the payouts associated therewith.

A suitable payout table is shown in Table 1.

TABLE 1

| COINS PLAYED | 1ST COIN | 2ND COIN | 3RD COIN | 4TH COIN | 5TH COIN |
|---|---|---|---|---|---|
| 7 OF A KIND (no wilds) | 10,000 | 20,000 | 30,000 | 40,000 | 50,000 |
| 6 OF A KIND (no wilds) | 500 | 1,000 | 1,500 | 2,000 | 2,500 |
| 2 SETS (one 4-one 3) (no wilds) | 125 | 250 | 375 | 500 | 625 |
| 7 OF A KIND (with wilds) | 100 | 200 | 300 | 400 | 500 |
| 5 OF A KIND (no wilds) | 40 | 80 | 120 | 160 | 200 |
| 2 SETS (one 4-one 3) (with wilds) | 25 | 50 | 75 | 100 | 125 |
| 2 SETS (both 3) (no wilds) | 15 | 30 | 45 | 60 | 75 |
| 6 OF A KIND (with wilds) | 8 | 16 | 24 | 23 | 40 |
| 4 OF A KIND (no wilds) | 4 | 8 | 12 | 16 | 20 |
| 5 OF A KIND (with wilds) | 2 | 4 | 6 | 8 | 10 |
| 4 OF A KIND (with wilds) | 1 | 2 | 3 | 4 | 5 |

As shown in Table 1, the jackpot that can be won for achieving a Seven of Kind (with no wild cards and the maximum number of coins bet) can be a flat amount (for example, 50,000 coins, tokens or credits). Alternatively, the payout for this hand can be a progressive jackpot which grows from a starting amount until won by some lucky player. The starting amount can be any level chosen that is suitable and this amount can increase at a rate determined by the operator of the gaming machine based on any suitable incrementing method, such as a portion of each coin wagered by the player being added to the jackpot or a portion of each fifth coin wagered by the player being added to the jackpot.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a card game that uses only the player's hand to determine winning and losing outcomes comprising:

a) providing a pack of one hundred six cards consisting of two standard decks of playing cards and two Jokers;

b) pre-establishing a group of winning card combinations for the card game, the winning card combinations consisting of Seven of a Kind with no wild cards, Six of a Kind with no wild cards, Two Sets—one Four of a Kind and one Three of a Kind with no wild cards, Seven of a Kind with wild cards, Five of a Kind with no wild cards, Two Sets—one Four of a Kind and one Three of a Kind with wild cards, Two Sets—each being a Three of a Kind with no wild cards, Six of a Kind with wild cards, Four of a Kind with no wild cards, Five of a Kind with wild cards and Four of a Kind with wild cards;

c) displaying an initial hand of seven cards from the pack of cards;

d) the player selecting which, if any, of the cards of the initial hand the player wishes to discard;

e) displaying replacement cards for those cards that the player has discarded, if any; and f) determining whether the resulting cards form a winning combination from the pre-established group of winning card combinations.

2. The method of claim 1 further including:

a) a player making a wager to be eligible to participate in the game; and b) paying the player a predetermined amount if the player achieves a winning combination of playing cards.

3. The method of claim 2 in which the winning card combinations are associated in a payout schedule based on the wager made by the player.

4. A method of playing a card game that uses only the player's hand to determine winning and losing outcomes comprising:

a) providing a pack of one hundred six cards consisting of two standard decks of playing cards and two Jokers;

b) pre-establishing a group of winning card combinations for the card game, the winning card combinations consisting of Seven of a Kind with no wild cards, Six of a Kind no wild cards with no wild cards, Two Sets—one Four of a Kind and one Three of a Kind with no wild cards, Seven of a Kind with wild cards, Five of a Kind with no wild cards, Two Sets—one Four of a Kind and one Three of a Kind with wild cards, Two Sets—each being a Three of a Kind with no wild cards, Six of a Kind with wild cards, Four of a Kind with no wild cards, Five of a Kind with wild cards and Four of a Kind with wild cards;

c) displaying an initial hand of seven cards from the pack of cards;

d) the player selecting which, if any, of the cards of the initial hand the player wishes to discard;

e) displaying replacement cards for those cards that the player has discarded, if any;

f) determining whether the resulting cards form a Seven of a Kind with no wild cards; and g) providing the player an award if a Seven of a Kind with no wild cards results.

5. The method of claim 4 further including:

a) a player making a wager to be eligible to participate in the game; and b) paying the player a predetermined amount if the player achieves a winning combination of playing cards.

6. The method of claim 5 in which the winning card combinations are associated in a payout schedule based on the wager made by the player.

* * * * *